US007541990B2

(12) United States Patent
Kuo

(10) Patent No.: US 7,541,990 B2
(45) Date of Patent: Jun. 2, 2009

(54) ROTATIONAL ANTENNA

(75) Inventor: Yung-Yu Kuo, Taipei Hsien (TW)

(73) Assignee: Wistron Corp., Taipei Hsien (TW)

( * ) Notice: Subject to any disclaimer, the term of this patent is extended or adjusted under 35 U.S.C. 154(b) by 78 days.

(21) Appl. No.: 11/769,333

(22) Filed: Jun. 27, 2007

(65) Prior Publication Data

US 2008/0088515 A1 Apr. 17, 2008

(30) Foreign Application Priority Data

Oct. 17, 2006 (TW) ..... 95218342 U

(51) Int. Cl.
*H01Q 1/24* (2006.01)

(52) U.S. Cl. ..... 343/702; 343/882; 343/906

(58) Field of Classification Search ..... 343/702, 343/882, 906
See application file for complete search history.

(56) References Cited

U.S. PATENT DOCUMENTS 5,850,612 A * 12/1998 Kulberg et al. ..... 455/575.7
6,208,300 B1 * 3/2001 Johnson ..... 343/702
6,317,085 B1 * 11/2001 Sandhu et al. ..... 343/702
6,469,668 B1 * 10/2002 Jones et al. ..... 343/702
6,518,928 B1 * 2/2003 Sheu ..... 343/702
7,173,576 B2 * 2/2007 O'Neill et al. ..... 343/895
7,184,852 B2 * 2/2007 Lee et al. ..... 700/115
7,375,690 B2 * 5/2008 Chen ..... 343/702
2008/0030409 A1 * 2/2008 Shih ..... 343/702
2008/0308755 A1 * 12/2008 Hashizume et al. ..... 250/553

* cited by examiner

*Primary Examiner*—Douglas W. Owens
*Assistant Examiner*—Chuc Tran
(74) *Attorney, Agent, or Firm*—Thomas, Kayden, Horstemeyer & Risley

(57) ABSTRACT

A rotational antenna is disclosed. The rotational antenna includes a radiating member and a pivot. The radiating member preferably comprises a curved portion. The pivot further includes an axle and a body. The axle is coupled to the curved portion, and the body is electrically connected to a wireless communication device. Accordingly, the pivot is disposed within the wireless communication device and hidden inside the wireless communication device. The damage of the pivot can be avoided when moving the wireless communication device.

4 Claims, 4 Drawing Sheets

ROTATIONAL ANTENNA

RELATED APPLICATIONS

The application claims priority to Taiwan Application Serial Number 95218342, filed Oct. 17, 2006, which is herein incorporated by reference.

FIELD OF THE INVENTION

The present invention generally relates to a rotational antenna. More particularly, this invention relates to a rotational antenna with a hidden pivot.

BACKGROUND OF THE INVENTION

Wireless communication technology is highly developed and becoming more popular. Wireless communication devices, such as conventional radios, computer wireless devices or digital television boxes, normally use an antenna to transmit and receive wireless signals. However, most wireless communication devices include pivots protruding from the bodies of the wireless communication devices. The protruding pivot may easily interfere with surrounding environmental objects when the wireless communication device is used in a limited and restricted space. In addition, the protruding pivot can easily be damaged by accident.

FIG. 1 is an illustration of a conventional rotational antenna. The conventional rotational antenna 100 includes a bar portion 102 and a pivot 104. The bar portion 102 can rotate on the pivot 104. However, the pivot 104 protrudes from the body of the wireless communication device 106. Therefore, when moving the wireless communication device, the pivot 104 of the rotational antenna 100 may easily touch other objects and therefore be damaged.

SUMMARY OF THE INVENTION

It is an objective of the present invention to provide a rotational antenna with a hidden pivot that does not reduce the wireless communication efficiency.

To accomplish the above objectives, the present invention provides a rotational antenna with a radiating member that includes a curved portion and a pivot. The pivot includes an axle and a pivot holder. The axle is connected to the curved portion and the pivot holder electrically connects to a wireless communication device. The pivot is preferably disposed inside the body of the wireless communication device.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is currently the best implementation of the present invention. This description is not to be taken in a limiting sense but is made merely to describe the general principles of the invention. The scope of the invention should be determined by referencing the appended claims.

Figure 1:
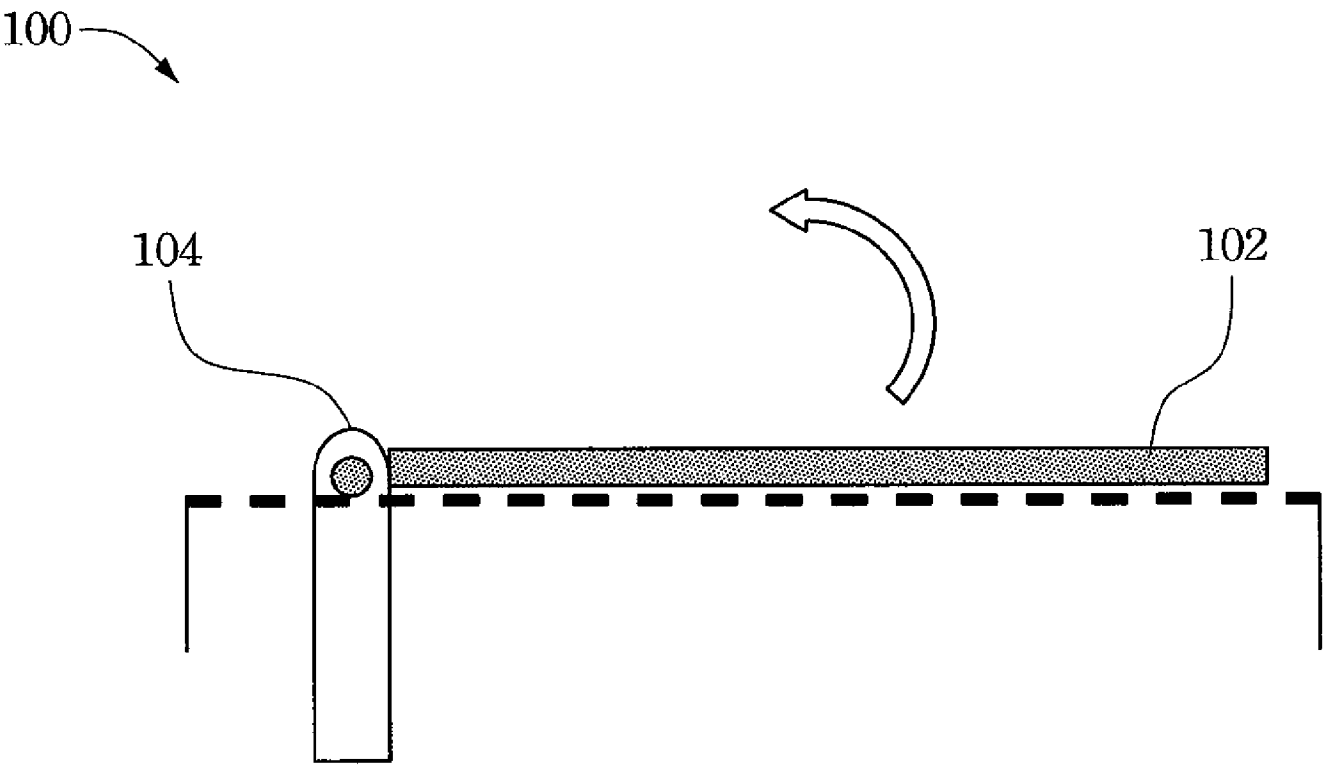
Fig. 1 (PRIOR ART)
FIG. 1 illustrates a conventional rotational antenna.
Figures 2A, 2B, 2C, 3A, 3B:
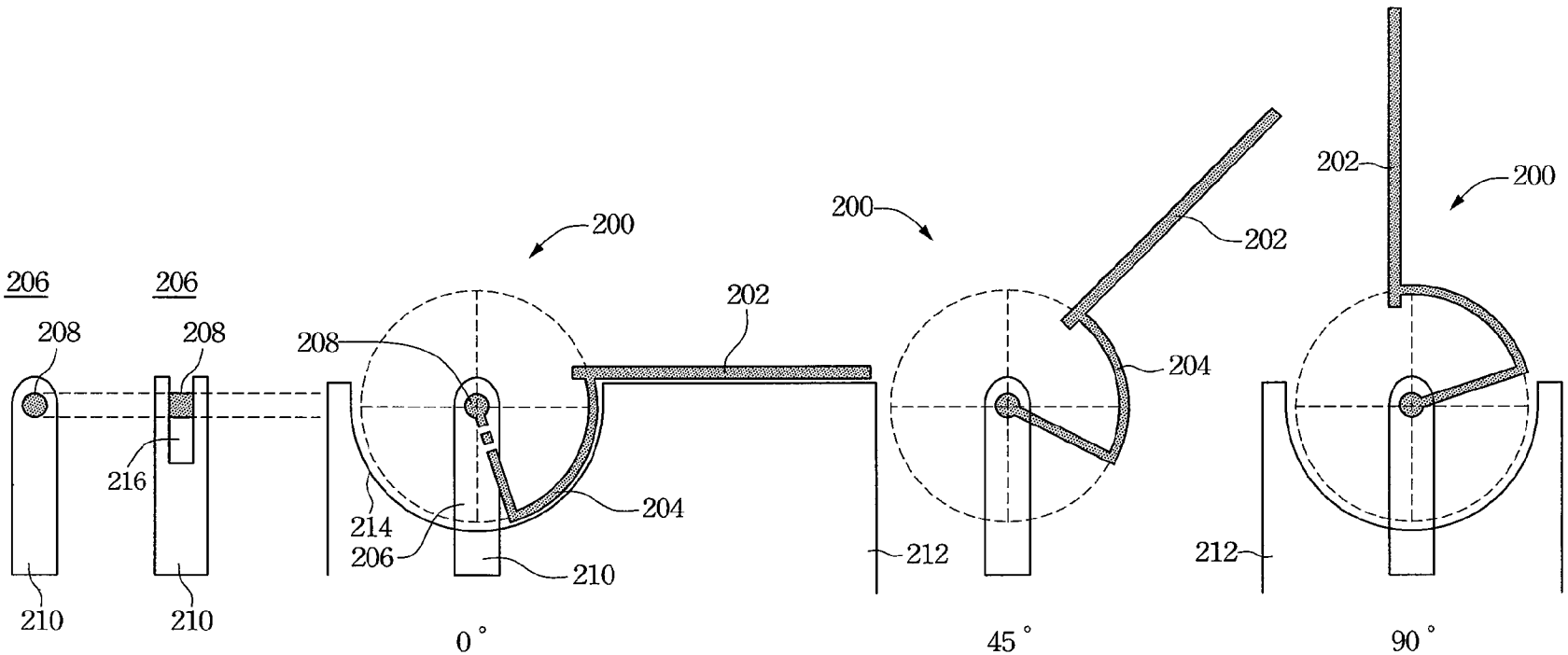
FIGS. 2A-2C illustrate a preferred embodiment of a rotational antenna according to the present invention.
FIG. 3A is a front view of the pivot of the preferred embodiment of FIGS. 2A-2C.
FIG. 3B is a side view of the pivot of the preferred embodiment of FIGS. 2A-2C.

FIG. 2A, FIG. 2B and FIG. 2C illustrate a preferred embodiment of a rotational antenna 200 according to the present invention. The antenna 200 includes a curved portion 204 and a pivot 206. The curved portion 204 is a radiating member and transmits and receives wireless signals. One end of the curved portion 204 connects to a bar portion 202 to extend the radiating member. The bar portion 202 connects to the curved portion 204, and the curved portion 204 connects to the axle 208 of the pivot 206. The pivot holder 210 of the pivot 206 electrically connects to a wireless communication device 212 to transmit/receive wireless signals to/from a communication module disposed inside the body of the wireless communication device 212. The pivot 206 is disposed inside the wireless communication device 212 so that the pivot 206 is not protruding from the surface of the wireless communication device 212. During the rest period, the bar portion 202 of the rotational antenna 200 can be stored parallel to the surface of the wireless communication device 212 and the curved portion 204 is stored in the receiving portion 214 of the wireless communication device 212. Referring to FIG. 2B, when the bar portion 202 of the rotational antenna 200 is rotated up about 45 degrees from the horizontal, a part of the curved portion 204 is exposed. Referring to FIG. 2C, when the bar portion 202 of the rotational antenna 200 is rotated up about additional 45 degrees, the bar portion 202 is perpendicular to the surface, to store the bar portion 202, of the wireless communication device 212. In addition, the curved portion 204 is exposed outside the wireless communication device 212. Since the total length of the bar portion and the curved portion is similar to the length of the bar portion of a conventional rotational antenna, the wireless communication efficiency of the present embodiment is similar to the conventional rotational antenna. The rotational antenna is preferably installed in a digital TV box to receive digital, analogy and/or multi-frequency signals.

FIG. 3A illustrates a front view of the pivot of the preferred embodiment of FIG. 2A, FIG. 2B and FIG. 2C, and FIG. 3B illustrates a side view thereof. The pivot 206 includes an axle 208 and a pivot holder 210. The axle 208 is disposed in a receiving portion 216 of the pivot holder 210 so that the rotational antenna 200 can be rotated through the axle 208 on the pivot 206 to about 180 degrees.

FIG. 4A, FIG. 4B, FIG. 4C, FIGS. 4D and 4E illustrate another preferred embodiment of the rotational antenna according to the present invention. The rotational antenna 400 includes a bar portion 402, a curved portion 404 and a pivot 406. The rotational antenna 400 includes a semi-circle curved portion 404. The curved portion 404 is approximately a quarter of a circle longer than the curved portion 204 of FIG. 2A-2C and the length of the bar portion 402 is therefore shorter than that of FIG. 2A-2C. The rotational antenna 400 can also be used in a wireless communication device with a small volume.

Figures 4A, 4B, 4C, 5A, 5B:
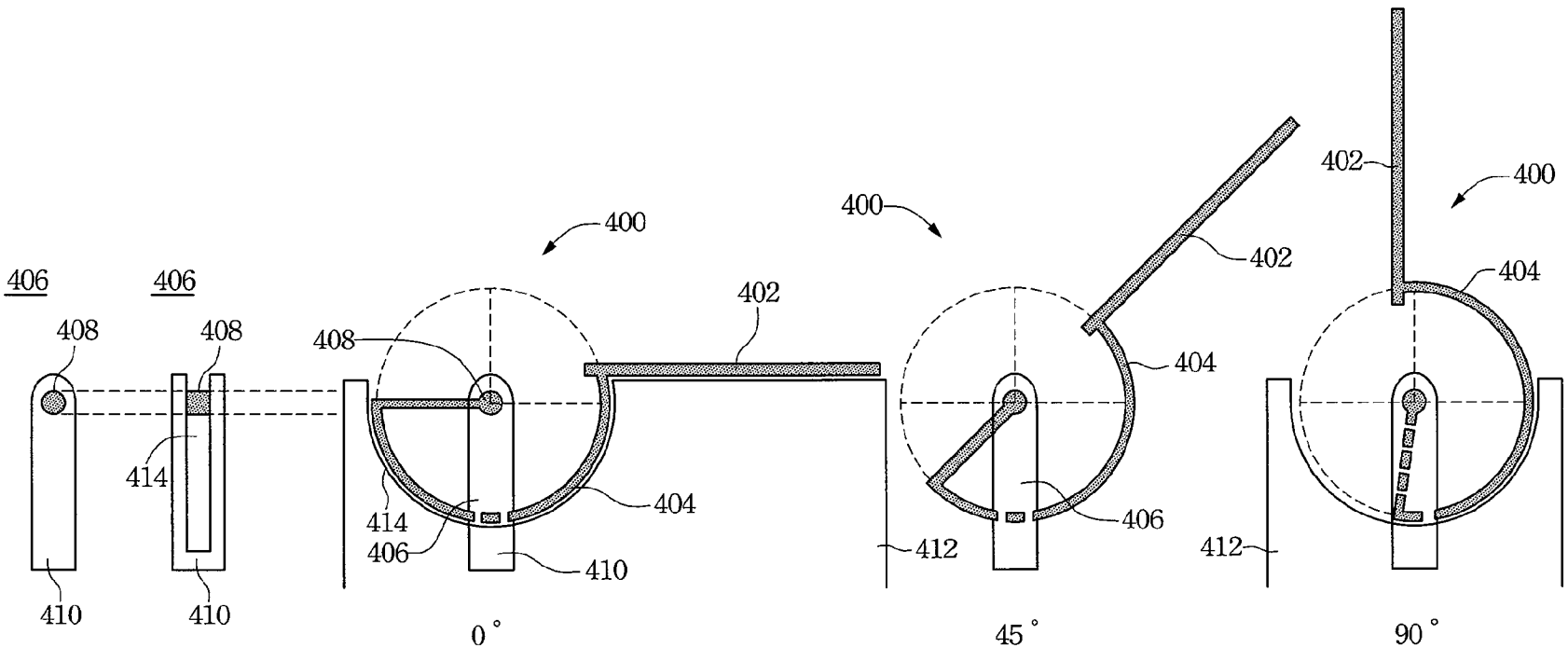
FIGS. 4A-4E illustrate another preferred embodiment of a rotational antenna according to the present invention.
FIG. 5A is a front view of the pivot of the preferred embodiment of FIGS. 4A-4E.
FIG. 5B is a side view of the pivot of the preferred embodiment of FIGS. 4A-4E.

Referring to FIG. 4A, the bar portion 402 connects to the curved portion 404 and the curved portion 404 connects to the axle 408 of the pivot 406. The pivot holder 410 of the pivot 406 is electrically connected to a wireless communication device 412. The pivot 406 is disposed inside the wireless communication device 412 so that the pivot 406 does not protrude from the surface of the wireless communication device 412. When the wireless communication device 412 at rest, the bar portion 402 of the rotational antenna 400 is parallel to one surface of the wireless communication device 412 and the curved portion 404 is stored inside a receiving portion 414 of the wireless communication device 412.

Figure 4E:
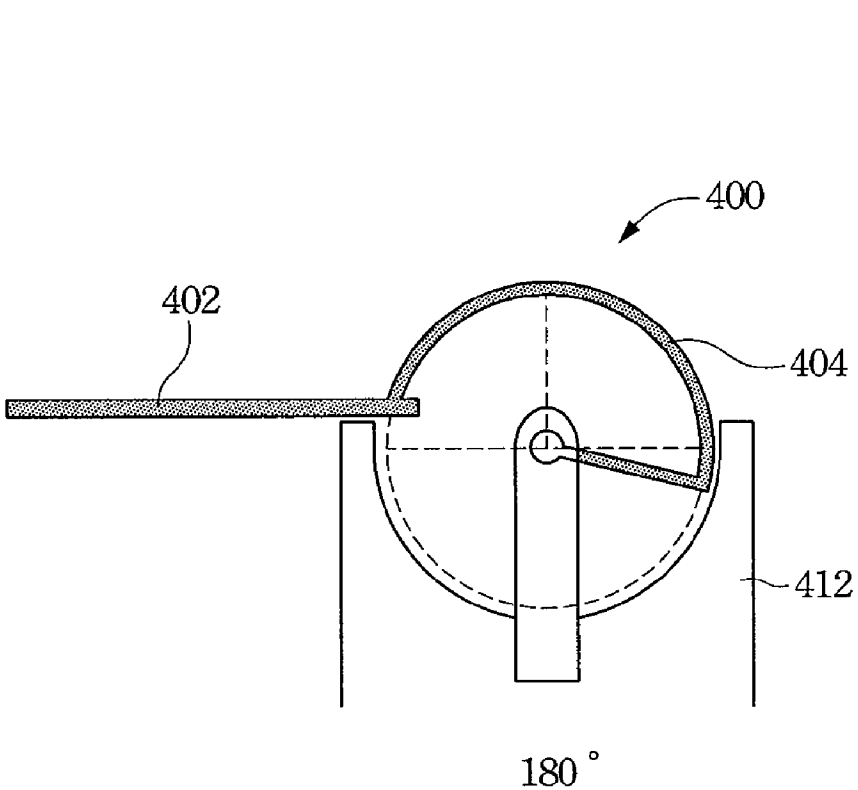
Figure 4D:
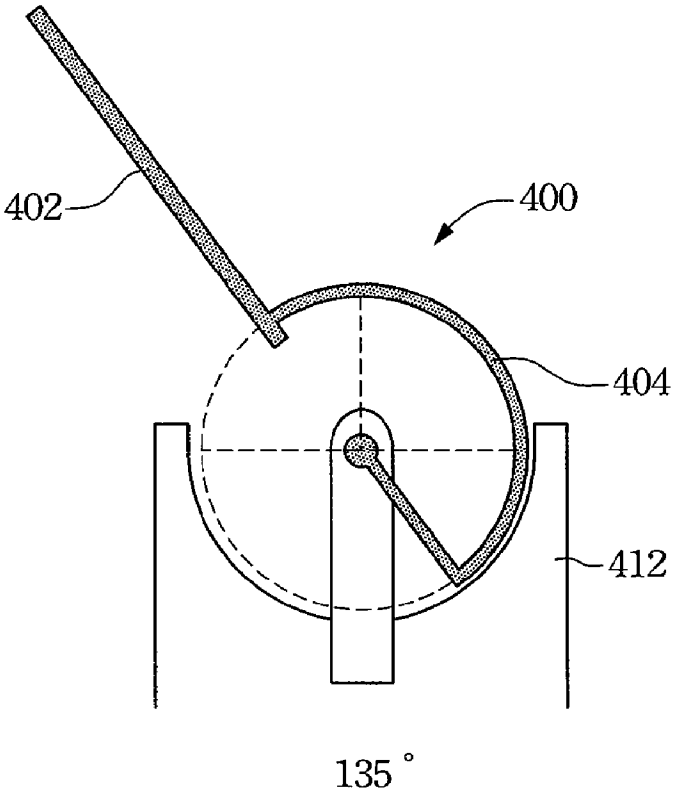

Referring to FIG. 4B, when the bar portion 402 of the rotational antenna 400 is rotated up about 45 degrees from the horizontal, a part of the curved portion 404 is exposed outside the wireless communication device 412. Referring to FIG. 4C, when the bar portion 402 of the rotational antenna 400 is rotated up by additional 45 degrees, the bar portion 402 is perpendicular to the surface, to store the bar portion 402, of the wireless communication device 412. In addition, a half of the curved portion 404 is exposed outside the wireless communication device 412. Referring to FIG. 4D, when the bar portion 402 of the rotational antenna 400 is rotated about 135 degrees from the horizontal, three quarters of the curved portion 404 is exposed outside the wireless communication device 412. Referring to FIG. 4E, when the bar portion 402 of the rotational antenna 400 is rotated about 180 degrees from the horizontal, the whole curved portion 404 is exposed outside the wireless communication device 412 and the bar portion 402 is parallel to the surface, to store the bar portion 402 of the rotational antenna 400. Since the total length of the bar portion 402 and the curved portion 404 is similar to the length of the bar portion of a conventional rotational antenna, the wireless communication efficiency of the present embodiment is similar to the conventional rotational antenna.

FIG. 5A illustrates a front view of the pivot of the preferred embodiment of FIG. 4A, FIG. 4B, FIG. 4C, FIG. 4D and FIG. 4E, and FIG. 5B illustrates a side view thereof. The pivot 406 includes an axle 408 and a pivot holder 410. The axle 408 is disposed in a receiving portion 416 of the pivot holder 410 so that the rotational antenna 400 can be rotated through the axle 408 on the pivot 406 by about 180 degrees.

As is understood by a person skilled in the art, the foregoing preferred embodiments of the present invention are illustrative of the present invention rather than limiting to the present invention. It is intended that various modifications and similar arrangements be included within the spirit and scope of the appended claims, the scope of which should be accorded the broadest interpretation so as to encompass all such modifications and similar structures.

What is claimed is:

1. A wireless communication device, comprising:

a main body having a receiving portion;

a communication module disposed in the main body; and an antenna, further comprising:

a radiating member including a curved portion; and a pivot disposed in the receiving portion of the main body and connected to the curved portion, wherein the antenna electrically connected to the communication module via the pivot, the curved portion of the radiating member is stored in the receiving portion during a rest period, and the curved portion of the radiating member is able to be exposed outside the receiving portion when the antenna is rotated around the pivot.

2. The wireless communication device of claim 1, wherein the curved portion of the radiating member is formed with a half circle.

3. The wireless communication device of claim 1, wherein the curved portion of the radiating member comprises a quarter circle.

4. The wireless communication device of claim 1, wherein the curved portion of the radiating member is partially received in the receiving portion of the main body.

* * * * *